US008848003B2

(12) United States Patent
Takahashi et al.

(10) Patent No.: US 8,848,003 B2
(45) Date of Patent: Sep. 30, 2014

(54) METHOD OF CHROMATICITY ADJUSTMENT OF DISPLAY DEVICE

(75) Inventors: Yuu Takahashi, Ichikawa (JP); Norio Nakanishi, Chiba (JP)

(73) Assignees: Japan Display Inc., Tokyo (JP); Panasonic Liquid Crystal Display Co., Ltd., Hyogo (JP)

( * ) Notice: Subject to any disclaimer, the term of this patent is extended or adjusted under 35 U.S.C. 154(b) by 55 days.

(21) Appl. No.: 13/239,728

(22) Filed: Sep. 22, 2011

(65) Prior Publication Data

US 2012/0081414 A1 Apr. 5, 2012

(30) Foreign Application Priority Data

Sep. 30, 2010 (JP) ..... 2010-220419

(51) Int. Cl.
*G09G 5/10* (2006.01)
*G09G 3/36* (2006.01)

(52) U.S. Cl.
CPC ..... *G09G 3/3648* (2013.01); *G09G 2320/0285* (2013.01); *G09G 2320/0242* (2013.01); *G09G 2320/0276* (2013.01); *G09G 2360/145* (2013.01)
USPC ..... 345/690; 345/87; 345/88; 345/589; 382/162; 382/167

(58) Field of Classification Search
USPC ..... 345/87, 102, 204, 690
See application file for complete search history.

(56) References Cited

U.S. PATENT DOCUMENTS

| | | | | |
|---|---|---|---|---|
| 2006/0071940 | A1* | 4/2006 | Ouchi | 345/600 |
| 2007/0035536 | A1* | 2/2007 | Alessi et al. | 345/207 |
| 2008/0252653 | A1* | 10/2008 | Alessi et al. | 345/589 |
| 2008/0297456 | A1* | 12/2008 | Marcu et al. | 345/88 |
| 2009/0033612 | A1* | 2/2009 | Roberts et al. | 345/102 |
| 2009/0115711 | A1* | 5/2009 | Ueyama | 345/87 |
| 2010/0060911 | A1* | 3/2010 | Marcu et al. | 358/1.9 |
| 2010/0194771 | A1 | 8/2010 | Harayama et al. | |

FOREIGN PATENT DOCUMENTS

| | | |
|---|---|---|
| JP | 2006-91235 | 4/2006 |
| JP | 2007-128822 | 5/2007 |
| JP | 2010-181430 | 8/2010 |

* cited by examiner

*Primary Examiner* — Grant Sitta
(74) *Attorney, Agent, or Firm* — Antonelli, Terry, Stout & Kraus, LLP.

(57) ABSTRACT

Provided is a method of chromaticity adjustment of a display device including a drive circuit for generating a gray-scale signal corresponding to a video signal input from an external portion and supplying the gray-scale signal to a plurality of pixels, the method including: measuring chromaticity coordinates of an image displayed on the display device; determining whether the measured chromaticity coordinates are chromaticity coordinates within a first region that does not need a chromaticity correction or chromaticity coordinates within a second region that needs the chromaticity correction; determining, if the measured chromaticity coordinates are the chromaticity coordinates within the second region, which of a plurality of correction regions obtained by dividing the second region the chromaticity coordinates fall within; correcting the gray-scale signal corresponding to the video signal by using a chromaticity correcting portion corresponding to the determined one of the plurality of correction regions; and performing corrected image display.

9 Claims, 5 Drawing Sheets

METHOD OF CHROMATICITY ADJUSTMENT OF DISPLAY DEVICE

CROSS-REFERENCE TO RELATED APPLICATION

The present application claims priority from Japanese application JP 2010-220419 filed on Sep. 30, 2010, the content of which is hereby incorporated by reference into this application.

BACKGROUND OF THE INVENTION

1. Field of the Invention

The present invention relates to a method of chromaticity adjustment of a display device, in particular, a method of chromaticity adjustment of a liquid crystal display device including a backlight unit.

2. Description of the Related Art

A liquid crystal display device has a structure including: a backlight unit for emitting a plane-shaped backlight beam; and a liquid crystal display panel having a plurality of pixels arranged in a matrix shape, for performing image display according to a video signal input from an external device with the backlight beam as a light source. In particular, a compact liquid crystal display device using a white LED, which is advantageous in achieving downsizing, lightweight, and low power consumption, as the light source of the backlight unit is becoming widespread rapidly.

The liquid crystal display device is configured to perform the image display corresponding to the video signal by controlling a transmission amount of the backlight beam for each pixel. For this reason, the liquid crystal display device is configured to perform the image display by maximizing the transmission amount of the backlight beam from the backlight unit in the case of performing white display. Therefore, a chromaticity tolerance of the liquid crystal display device greatly depends on a whiteness tolerance of the white LED used as the light source.

Meanwhile, LEDs produced for backlight of the liquid crystal display device exhibit a large chromaticity unevenness, and under present circumstances, the chromaticity tolerance of the LED does not satisfy the chromaticity tolerance of the liquid crystal display device or the chromaticity tolerance of the backlight which is demanded in the market. At present, white LEDs exhibiting a large chromaticity unevenness are classified into a plurality of ranks according to the magnitude of unevenness (magnitude of a deviation from a chromaticity designed value), and a □ characteristic of the liquid crystal display device is adjusted according to each rank to thereby suppress the chromaticity tolerance of the liquid crystal display device and the chromaticity tolerance of the backlight within a required range.

In recent years, there have been demands for further improvements in display quality, and also in the liquid crystal display device using a white LED, there are demands for further compliance with a narrow whiteness tolerance that suppresses unevenness in whiteness. As the compliance with the narrow whiteness tolerance, it is conceivable that, at the time of manufacturing, the whiteness and the γ characteristic are measured for each liquid crystal display device, and data on the γ characteristics is corrected based on the measured values. However, an extremely large amount of time is required in order to measure the γ characteristics of all the liquid crystal display devices at the time of manufacturing and correct the data on the γ characteristics based on the measured values, which could cause a significant reduction of manufacturing throughput.

As a technology for causing the chromaticity of the liquid crystal display device to fall within a predetermined chromaticity tolerance even when using an LED exhibiting a large chromaticity unevenness, there are technologies disclosed in Japanese Patent Application Laid-open No. 2010-181430 and Japanese Patent Application Laid-open No. 2007-128822.

Further, there is a technology disclosed in Japanese Patent Application Laid-open No. 2006-91235 as a technology for correcting the γ characteristic and the chromaticity of the backlight. In the technology disclosed in Japanese Patent Application Laid-open No. 2006-91235, a color sensor is disposed for each liquid crystal display panel, a comparison is performed between chromaticity information measured by the color sensor and a reference value of the chromaticity information, a correction is made to a color conversion table including γ characteristics based on a comparison result thereof, and the corrected color conversion table is used to generate an output value.

SUMMARY OF THE INVENTION

However, in the technology disclosed in Japanese Patent Application Laid-open No. 2006-91235, the color sensor needs to be formed to each liquid crystal display device, and a circuit for generating the color conversion table corresponding to the output value of the color sensor is also necessary, which could cause a upsizing of the liquid crystal display device. In addition, in the same manner as in the white LED, because the output value of the color sensor also exhibits a predetermined unevenness, the characteristics of all the color sensors need to be measured at the time of manufacturing to generate correction data for correcting sensor characteristics based on the measured values, which could causes a significant reduction of the manufacturing throughput.

Further, it is conceivable that only LEDs of a rank exhibiting a small chromaticity unevenness are used, but it is difficult to produce or purchase only the LEDs of the above-mentioned rank, and the other LEDs classified into a rank exhibiting a large chromaticity unevenness become wasteful, which raises a problem that manufacturing cost greatly increases.

The present invention has been made in view of the above-mentioned problems, and an object of the present invention is to provide a technology capable of performing chromaticity adjustment with simple adjustment at the time of manufacturing and falling a chromaticity of a display device within a chromaticity tolerance even if there is a large unevenness in a light source of backlight.

(1) In order to solve the above-mentioned problems, there is provided a method of chromaticity adjustment of a display device including a plurality of pixels, a drive circuit for generating a gray-scale signal corresponding to a video signal input from an external portion and supplying the gray-scale signal to the plurality of pixels, the method including: measuring chromaticity coordinates of an image displayed on the display device; determining whether the measured chromaticity coordinates are chromaticity coordinates within a first region that does not need a chromaticity correction or chromaticity coordinates within a second region that needs the chromaticity correction; determining, if the measured chromaticity coordinates are the chromaticity coordinates within the second region, which of a plurality of correction regions obtained by dividing the second region the chromaticity coordinates fall within; correcting the gray-scale signal corresponding to the video signal by using the chromaticity correcting means corresponding to the determined one of the plurality of correction regions; and performing corrected image display.

(2) The image displayed on the display device is a white-color display with a maximum gray level.

(3) The correcting includes correcting a chromaticity by changing a γ characteristic of the display device.

(4) The plurality of pixels include a red pixel, a green pixel, and a blue pixel, and the correcting further includes correcting the gray-scale signal to be supplied to the red pixel, the gray-scale signal to be supplied to the green pixel, and the gray-scale signal to be supplied to the blue pixel independently of one another.

(5) The drive circuit stores correction data corresponding to each of the plurality of correction regions in advance, and the correcting includes selecting the correction data corresponding to the determined one of the plurality of correction regions and correcting the gray-scale signal based on the selected correction data.

(6) The drive circuit acquires correction data corresponding to each of the plurality of correction regions, and the correcting includes correcting the gray-scale signal based on the acquired correction data.

(7) The display device further includes a backlight unit using a white LED as a light source and a liquid crystal display panel disposed on a side of a surface of the backlight unit from which a backlight beam is emitted.

According to the present invention, it is possible to perform the chromaticity adjustment with simple adjustment at the time of manufacturing and cause the chromaticity of the display device to fall within the chromaticity tolerance even if there is a large unevenness in the light source of backlight.

Other effects of the present invention become clearer by the whole description of the specification.

DETAILED DESCRIPTION OF THE INVENTION

Hereinafter, embodiments to which the present invention is applied are described with reference to the accompanying drawings. Note that, in the following description, the same components are denoted by the same reference symbols, and repetitive description is omitted.

First Embodiment

Figure 1A:
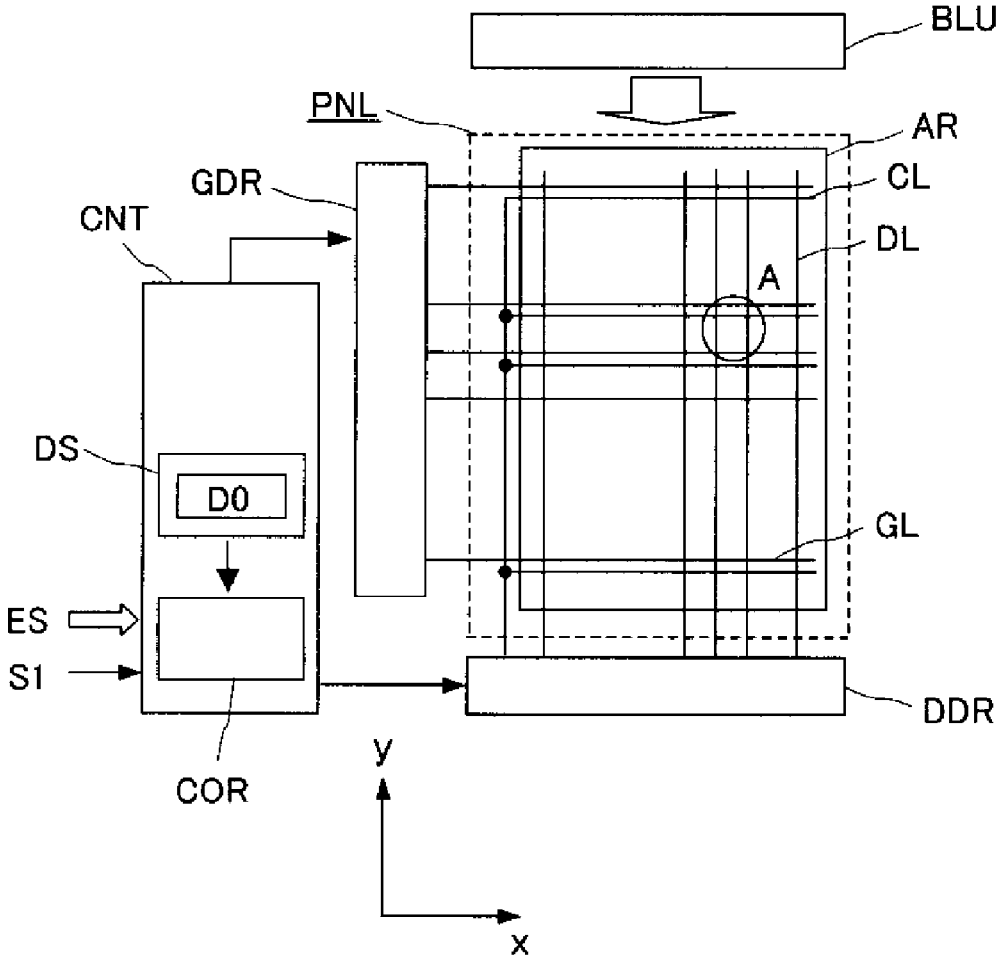
FIGS. 1A and 1B are diagrams for illustrating a schematic structure of a liquid crystal display device being a display device according to a first embodiment of the present invention.
Figure 1B:
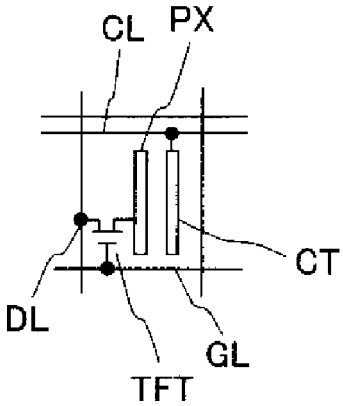

FIGS. 1A and 1B are diagrams for illustrating a schematic structure of a liquid crystal display device being a display device according to a first embodiment of the present invention. However, the present invention is not limited to the liquid crystal display device using white LEDs as a light source of backlight, and can be applied to a liquid crystal display device using another light-emitting element as the light source, another display device including a backlight unit, or the like.

The liquid crystal display device according to the first embodiment illustrated in FIGS. 1A and 1B includes a liquid crystal display panel PNL having a structure including a first substrate (not shown) on which a pixel electrode and the like are formed, a second substrate (not shown) on which a color filter and a black matrix (light shielding film) are formed and which is disposed so as to be opposed to the first substrate, and a liquid crystal layer (not shown) sandwiched by the first substrate and the second substrate, and the liquid crystal display device is constructed by combining the liquid crystal display panel PNL and a backlight unit BLU using white LEDs as the light source. Note that, the backlight unit BLU is disposed on a back surface of the liquid crystal display panel PNL. Fixation between the first substrate and the second substrate and sealing of liquid crystal therebetween are both realized by a sealing member (not shown) that is annularly applied to a peripheral portion of the second substrate. Note that, in the following description, the liquid crystal display device is referred to even in the description of the liquid crystal display panel PNL.

Further, in the liquid crystal display device according to the first embodiment, a display area AR represents a area in which display pixels (hereinafter, referred to simply as "pixels") are formed within a region in which the liquid crystal is filled. Therefore, the display area AR excludes a region in which a pixel is not formed and which is not involved in the display even within the region in which the liquid crystal is filled.

In addition, in the liquid crystal display device according to the first embodiment, gate lines GL, which extend in an X direction and are disposed in parallel with one another in a Y direction in FIGS. 1A and 1B, are formed within the display area AR on the surface on a liquid crystal side of the first substrate. Further formed are drain lines DL, which extend in the Y direction and are disposed in parallel with one another in the X direction in FIGS. 1A and 1B. A rectangular region surrounded by the drain lines DL and the gate lines GL constitutes a region in which a pixel is formed, which allows the respective pixels to be arranged in a matrix shape within the display area AR.

Each pixel includes, as illustrated in, for example, FIG. 1B being an enlarged view obtained by enlarging the part A of FIG. 1A, a thin film transistor TFT that is turned on by a scan signal received from the gate line GL, a pixel electrode (first electrode) PX to which a gray-scale signal (gray-scale voltage) is supplied from the drain line DL via the thin film transistor TFT that has been turned on, and a common electrode (second electrode) CT that is connected to a common line CL and supplied with a common signal having a reference electric potential against the potential of the gray-scale signal. Note that, the common electrode CT illustrated in FIG. 1B is configured so that the common signal is input to the common electrode CT formed separately for each pixel via the common line CL, but the present invention is not limited thereto, and the common electrode CT may be formed so that the common electrodes CT of the pixels arranged adjacently in the X direction are directly connected to each other and may be configured so that the common signal is input via the common line CL from one end of the right and left (end portions of the first substrate) in the X direction or from both sides thereof.

Each of the drain lines DL, for example at FIG. 1A, extends over the sealing member (not shown) at a lower end thereof and is connected to one output terminal of a gray-scale signal drive circuit (drain driver) DDR that is disposed at a lower end of the liquid crystal display panel PNL. In the same manner, each of the gate lines GL, for example, extends over the sealing member (not shown) at a left end thereof and is connected to one output terminal of a scan signal drive circuit (gate driver) GDR. Further, in the first embodiment, the gray-scale signal drive circuit DDR is configured to supply the common signal to the common line CL, and the common line CL also extends over the sealing member (not shown) and is connected to the output terminal of the gray-scale signal drive circuit DDR.

Further, the liquid crystal display device according to the first embodiment includes a controller CNT for generating various control signals to be supplied to the scan signal drive circuit GDR and the gray-scale signal drive circuit DDR based on an external signal (video signal) ES. In particular, in the first embodiment, the controller CNT includes a γ correction portion COR for correcting a γ characteristic of the gray-scale signal to be output from the gray-scale signal drive circuit DDR based on the external signal ES and a data storage portion DS for storing γ correction data for a γ correction (γ characteristic after the correction). In this case, in the first embodiment, initial-value γ data D0 having an initial-value γ characteristic is stored.

In addition, the data storage portion DS according to the first embodiment is configured to allow stored data to be rewritten, and as described later in detail, has the γ correction data written thereto as an S1 signal according to a measurement result of a chromaticity value obtained at the time of white-color display based on the initial-value γ data D0.

Further, the liquid crystal display device according to the first embodiment has a structure connected to a printed board (not shown) such that, for example, the controller CNT is mounted to the printed board and the gray-scale signal drive circuit DDR and the scan signal drive circuit GDR are mounted to the first substrate. However, the present invention is not limited to this structure, and the gray-scale signal drive circuit DDR and the scan signal drive circuit GDR may be mounted to, for example, a flexible printed board by a tape carrier method or a chip on film (COF) method. Further, the gray-scale signal drive circuit DDR and the scan signal drive circuit GDR may be formed of TFTs using low temperature polysilicon and may be embedded in the first substrate.

Figure 2:
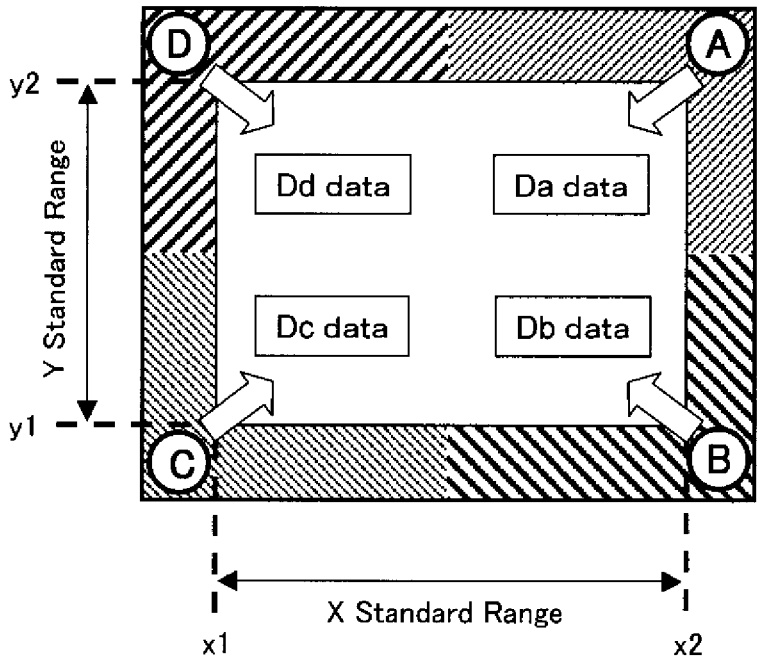
FIG. 2 is a diagram for illustrating an outline of a method of correcting a whiteness of the liquid crystal display device according to the first embodiment of the present invention.

FIG. 2 is a diagram for illustrating an outline of a method of correcting a whiteness of the liquid crystal display device according to the first embodiment of the present invention. Note that, a standard range of the whiteness of the liquid crystal display device illustrated in FIG. 2 is defined by an x-coordinate standard range and a y-coordinate standard range in a CIE xy chromaticity diagram. That is, the standard of the whiteness (tolerance of the chromaticity coordinates) of the liquid crystal display device indicates an x-coordinate range between x1 and x2 and a y-coordinate range between y1 and y2. Therefore, four regions A to D illustrated in FIG. 2 are regions of the chromaticity coordinates which fall outside the standard of the whiteness of the liquid crystal display device.

In the correction of the whiteness according to the first embodiment, the whiteness of the liquid crystal display device is measured, and if the measured whiteness falls outside the standard range of the whiteness illustrated in FIG. 2, the γ correction is performed so as that the whiteness of the liquid crystal display device can fall within the standard range.

In this case, in the first embodiment, a region outside the standard range is divided into the four regions (correction regions) A to D, one γ correction data item is provided for each of the four regions (correction regions) in advance, and according to the measured whiteness, any one of the γ correction data items corresponding to the four ranges is used so as that the whiteness of the liquid crystal display device can fall within the standard range. Of the four γ correction data items provided in this case, Da data (Da) represents a γ correction data item corresponding to the region A, Db data (Db) represents a γ correction data item corresponding to the region B, Dc data (Dc) represents a γ correction data item corresponding to the region C, and Dd data (Dd) represents a γ correction data item corresponding to the region D. However, the number of regions outside the standard range is not limited to the four regions, and a plurality of regions suffice. Note that, a procedure for selecting the γ correction data item is described later in detail.

Next, with reference to FIG. 3 which is a diagram for illustrating a schematic configuration of a whiteness adjustment system corresponding to the liquid crystal display device according to the first embodiment of the present invention and FIG. 4 which is a flowchart for illustrating an adjustment procedure according to the first embodiment of the present invention, a procedure for adjusting the whiteness is described below.

Figure 3:
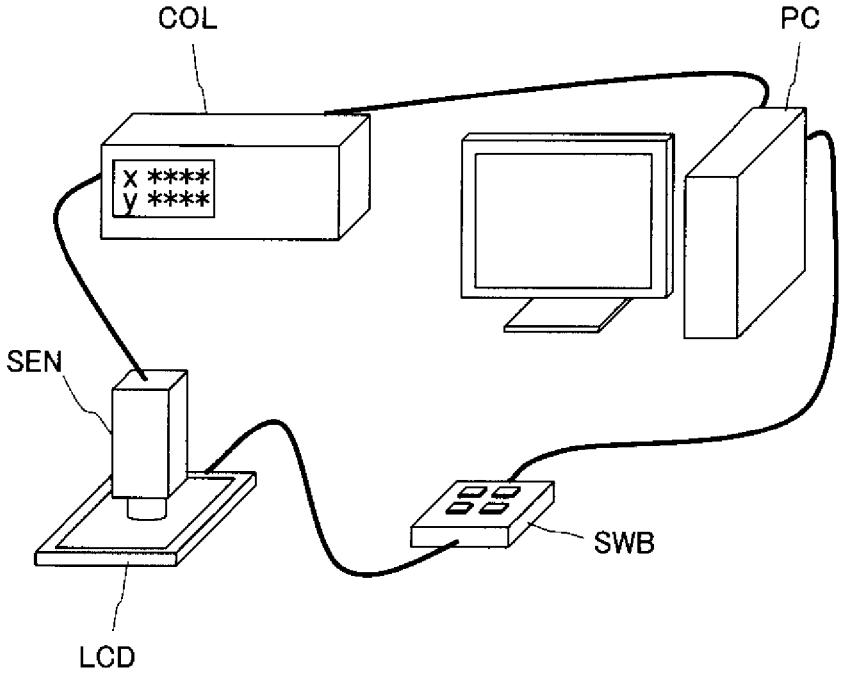
FIG. 3 is a diagram for illustrating a schematic configuration of a whiteness adjustment system corresponding to the liquid crystal display device according to the first embodiment of the present invention.

As illustrated in FIG. 3, the whiteness adjustment system according to the first embodiment has an extremely simple configuration including a camera portion SEN that functions as a sensor for converting light emitted in the white-color display of a liquid crystal display device LCD being an adjustment subject into a pixel-basis electrical signal of red (R), green (G), and blue (B), a chromaticity meter COL for calculating the whiteness of the CIE xy chromaticity diagram from an intensity of the obtained RGB signal, a personal computer PC for performing management, analysis, and the like of the obtained whiteness, and a switchbox SWB for issuing an instruction to write the γ correction data and the like. In this case, the whiteness adjustment system according to the first embodiment is configured to output the external signal ES for performing white display (white-color display with a maximum gray level) from the personal computer PC to the liquid crystal display device LCD.

In this case, as described later in detail, the whiteness adjustment system according to the first embodiment only determines whether the chromaticity coordinates of the liquid crystal display device LCD at the time of the white display (white-color display with a maximum gray level) falls within a range (first region) defined by the x-coordinate standard range and the y-coordinate standard range illustrated in FIG. 2 or falls within a range (second region) of any one of the four regions outside the standard range. Therefore, it is possible to measure the chromaticity coordinates with the simple camera portion SEN and the simple chromaticity meter COL, which can produce a remarkable effect of allowing the whiteness adjustment system to have a simple configuration.

Figure 4:
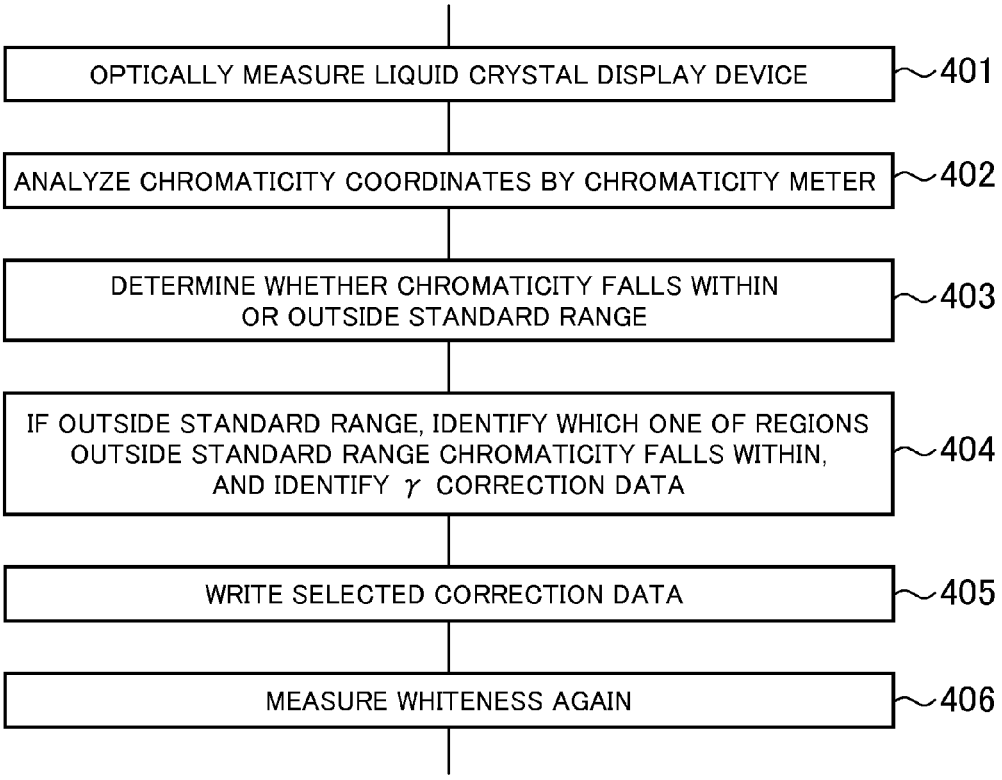
FIG. 4 is a flowchart for illustrating an adjustment procedure according to the first embodiment of the present invention.

Next, with reference to FIG. 4, description is made of a procedure for adjusting the whiteness using the whiteness adjustment system according to the first embodiment.

First, after the camera portion SEN is located on a side of a display surface of the liquid crystal display device LCD, the switchbox SWB is operated to input the external signal ES for the white display to the liquid crystal display device LCD, to thereby cause the liquid crystal display device LCD to perform the white-color display. The white display performed by the liquid crystal display device LCD is photographed by the camera portion SEN, converted into electrical signals corresponding to an RGB-basis luminance and chromaticity, and output to the chromaticity meter COL (Step 401).

Based on the electrical signals corresponding to the RGB-basis luminance and chromaticity at the time of the white display, the chromaticity coordinates are calculated by the chromaticity meter COL, and the chromaticity coordinates are output to the personal computer PC (Step 402).

Here, the personal computer PC stores the x-coordinate standard range (x1-x2) and the y-coordinate standard range (y1-y2) illustrated in FIG. 2. The chromaticity coordinates calculated by the chromaticity meter COL are compared to preset standard range values, and it is determined based on comparison results thereof whether or not the chromaticity coordinates indicate a chromaticity within the standard range, that is, fall within a preset chromaticity range (Step 403).

If it is determined in Step 403 that the measured chromaticity coordinates fall within the standard range, it is unnecessary to adjust the whiteness. On the other hand, if it is determined in Step 403 that the chromaticity coordinates fall outside the standard range, the personal computer PC then identifies based on the chromaticity coordinates which one of the four regions A to D outside the standard range the chromaticity coordinates fall within. Subsequently, the personal computer PC identifies the γ correction data item corresponding to the identified region outside the standard range (Step 404).

After that, the new γ correction data item is written to the liquid crystal display device so as to replace the initial-value γ data D0 by the identified and read γ correction data item (Step 405).

After that, in Step 406, the external signal ES for the white display is again output to the liquid crystal display device LCD, and the white display is performed and photographed by the camera portion SEN to thereby measure the whiteness again.

After Step 406, the above-mentioned Step 402 and the subsequent steps are executed again. If it is determined in Step 403 that the measured chromaticity coordinates fall within the standard range, the adjustment processing is brought to an end.

In whiteness adjustment performed for the liquid crystal display device according to the first embodiment, the number of divided regions outside the standard range matches the number of γ correction data items, that is, only one γ correction data item corresponds to one divided region, and hence it is unnecessary to perform the γ correction after generating a γ correction data item for every individual magnitude of chromaticity unevenness. Therefore, it is possible to greatly reduce the time required for the γ correction and the whiteness adjustment. Further, it is possible to realize simplification of the whiteness adjustment system and simplification of chromaticity adjustment work. In addition, the liquid crystal display device according to the first embodiment is configured to take an image of the display of the liquid crystal display device LCD by the camera portion SEN, which allows the γ correction and the whiteness adjustment including the adjustment of unevenness in optical characteristics possessed by the individual liquid crystal display panels PNL. Accordingly, the whiteness adjustment can be performed with higher accuracy than the whiteness adjustment based on only illumination light from the backlight unit BLU.

Figure 5:
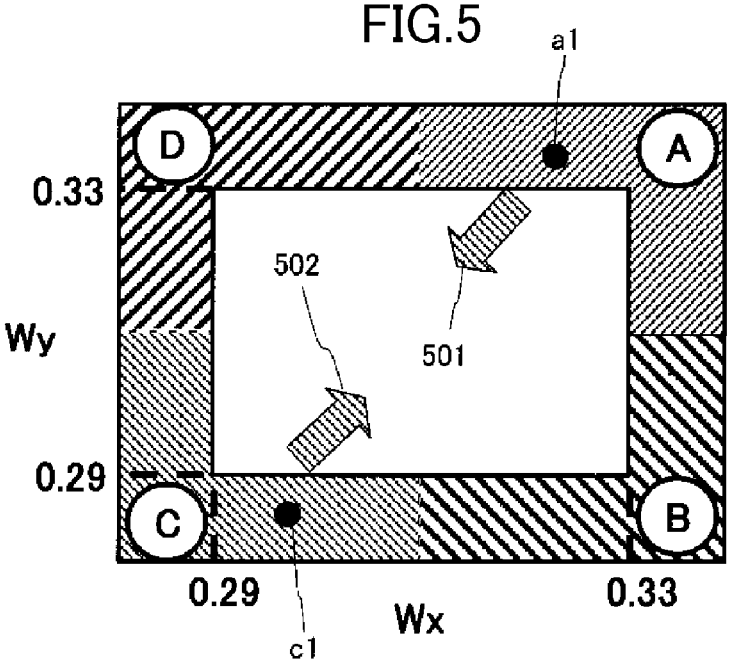
FIG. 5 is a diagram for illustrating a standard range of the while tolerance of liquid crystal display device according to the first embodiment of the present invention and a principle of a γ correction made thereto in a case where the standard range is exceeded.
Figure 6A:
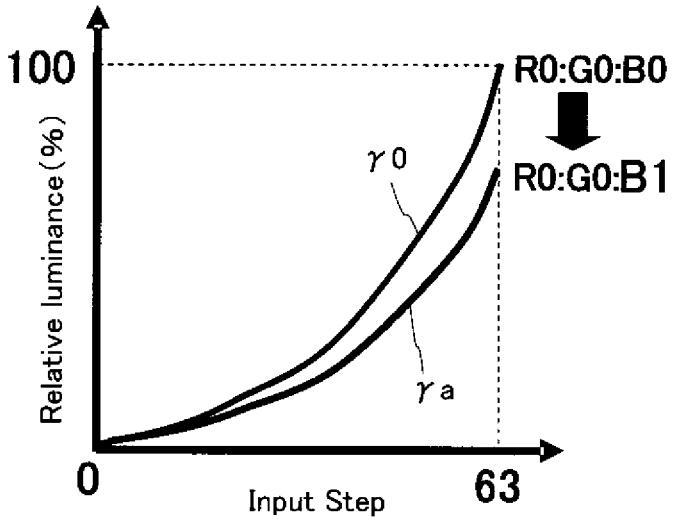
FIGS. 6A and 6B are diagrams for illustrating examples of the γ correction made to the liquid crystal display device according to the first embodiment of the present invention.
Figure 6B:
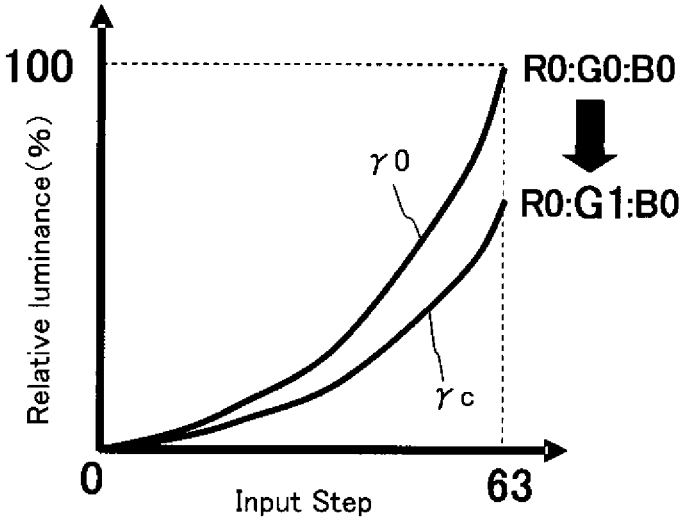

Next, with reference to FIG. 5 which is a diagram for illustrating the standard range of the liquid crystal display device according to the first embodiment of the present invention and a principle of a γ correction made thereto in a case where the standard range is exceeded and FIGS. 6A and 6B which are diagrams for illustrating an example of the γ correction made to the liquid crystal display device according to the first embodiment of the present invention, chromaticity adjustment based on the γ correction made to the liquid crystal display device according to the first embodiment is described below. Note that, of FIGS. 6A and 6B, FIG. 6A is a diagram illustrating a correction operation using the γ correction data item corresponding to the region A illustrated in FIG. 5, and FIG. 6B is a diagram illustrating a correction operation using the γ correction data item corresponding to the region C illustrated in FIG. 5. In FIGS. 6A and 6B, symbols such as R0, G0, and B0 indicate a gray-scale output of each color.

In FIG. 5, as an example, the standard range of a chromaticity x-coordinate Wx is set to a range between 0.29 and 0.33, and the standard range of a chromaticity y-coordinate Wy is set to a range between 0.29 and 0.33.

If the measured chromaticity coordinates reach a point a1 of FIG. 5, the point a1 is included in the region A, and hence, for example, an initial-value γ characteristic γ0 is corrected as γa by the γ correction data item Da corresponding to the region A. Here, of the chromaticity coordinate values exemplified in FIG. 5, the chromaticity of the region A has a larger blue component than the chromaticity within the standard range. Therefore, as illustrated in FIG. 6A, in such a manner that only the gray scale of blue (B) becomes smaller than those of the other red (R) or green (G) when the respective gray scales are output (in FIG. 6A, only the gray scale B0 changes to the gray scale B1, that is, the gray scale of each color is corrected independently), the γ correction data item Da for shifting the whiteness in a direction indicated by the arrow 501 is substitute for the initial-value γ data D0 and stored in the data storage portion DS.

On the other hand, if the measured chromaticity coordinates reach a point c1 of FIG. 5, the point c1 is included in the region C, and hence, for example, the initial-value γ characteristic γ0 is corrected as γc by the γ correction data item Dc corresponding to the region C. Here, of the chromaticity coordinate values exemplified in FIG. 5, the chromaticity of the region C has a larger green component than the chromaticity within the standard range. Therefore, as illustrated in FIG. 6B, in such a manner that only the gray scale of green (G) becomes smaller than those of the other red (R) or blue (B) when the respective gray scales are output (in FIG. 6B, only the gray scale G0 changes to the gray scale G1), the γ correction data item. Dc for shifting the whiteness in a direction indicated by the arrow 502 is substitute for the initial-value γ data D0 and stored in the data storage portion DS.

As described above, in the liquid crystal display device according to the first embodiment, the region of the chromaticity coordinates that fall outside the standard of the whiteness of the liquid crystal display device is divided into four correction regions, the γ correction data that sets a correction amount previously for each of the four correction regions is provided, the liquid crystal display device LCD performs the white-color display, the chromaticity coordinates at the time of the white-color display are measured, the measured chromaticity coordinates are determined as to whether the chromaticity coordinates fall within or outside the standard range, if outside the standard range, it is determined which of the four correction regions the chromaticity coordinates fall within, the gray-scale signal corresponding to the video signal input from an external portion is corrected by using the γ correction data corresponding to the identified correction region, and image display is performed by the corrected γ characteristic. Therefore, even if the white LEDs used as the light source exhibit a large chromaticity unevenness, the display device in which the whiteness is caused to fall within the standard range can be manufactured with simple adjustment at the time of manufacturing. As a result, it is also possible to use LEDs having a larger deviation in chromaticity from a chromaticity designed value than the conventional technology, which can produce a remarkable effect of being able to reduce the cost of members.

Second Embodiment

Figure 7:
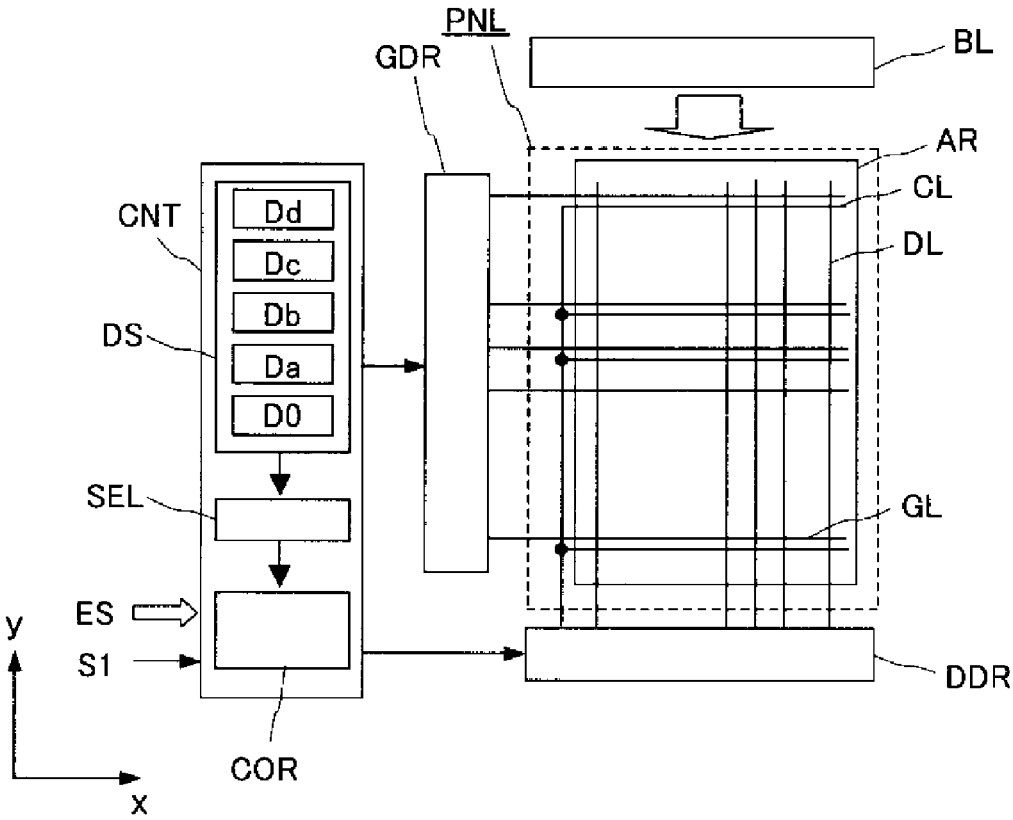
FIG. 7 is a diagram for illustrating a schematic structure of a liquid crystal display device being a display device according to a second embodiment of the present invention.

FIG. 7 is a diagram for illustrating a schematic structure of a liquid crystal display device being a display device according to a second embodiment of the present invention, which is the same as the liquid crystal display device of the first embodiment except for the configuration of the controller CNT. Therefore, in the following description, the controller CNT is described in detail.

As illustrated in FIG. 7, in the controller CNT according to the second embodiment, the data storage portion DS is configured to store the γ correction data items Da to Dd corresponding to the regions A to D as well as the initial-value γ data D0 being the initial value of the γ correction data. In this case, in the controller CNT according to the second embodiment, a data selection portion SEL is configured to select any one of the data items D0 and Da to Dd according to a selection signal input as the S1 signal and output the selected one to the γ correction portion COR. With this configuration, based on the γ correction data item selected by the data selection portion SEL, the γ correction portion COR corrects the γ characteristic of the gray-scale signal to be output from the gray-scale signal drive circuit DDR based on the external signal ES. Therefore, in the second embodiment, what is written in Step 405 illustrated in FIG. 4 is only the data for selecting the selected correction data, and hence, in addition to the above-mentioned effect of the first embodiment, it is possible to greatly reduce the time required to switch the corrected γ correction data, which can produce a remarkable effect of being able to further reduce the work time.

An instruction to select the γ correction data item input as the S1 signal in this case is a signal for switching one γ correction data item among the five γ correction data items, and hence a signal having approximately three bits suffices.

The invention made by the present inventor is described above specifically based on the embodiments of the invention, but the present invention is not limited to the embodiments of the invention described above, and various changes can be made without departing from the gist thereof. For example, in the first embodiment, the method of the chromaticity adjustment of white color is described as an example, but the method can be applied to the chromaticity adjustment of another color.

Further, the present invention is not limited to chromaticity correcting means using the γ correction which is described specifically in the first embodiment. This is because, even when dividing the region (second region) that needs a chromaticity correction into a plurality of correction regions and using another chromaticity correcting means corresponding to each of the plurality of correction regions, it is unnecessary to perform the chromaticity correction for every individual magnitude of chromaticity unevenness, which can produce the above-mentioned effects of the present invention.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A method of chromaticity adjustment of a display device including a plurality of pixels and a drive circuit for generating a gray-scale signal corresponding to a video signal input from an external portion and supplying the gray-scale signal to the plurality of pixels, the method comprising:

a first step of measuring chromaticity coordinates of an image displayed on the display device;

a second step of determining whether the measured chromaticity coordinates are chromaticity coordinates within a first region of a CIE xy chromaticity diagram that does not need a chromaticity correction or chromaticity coordinates within a second region of the CIE xy chromaticity diagram that needs the chromaticity correction and that includes a plurality of correction regions, the plurality of correction regions being obtained by dividing the second region, and each of the correction regions having each of a plurality of chromaticity correcting means, the plurality of chromaticity correcting means being different from each other for each of the correction regions so that the chromaticity correction performed in each of the correction regions will be different than the chromaticity correction performed in the other correction regions;

a third step of determining, if the measured chromaticity coordinates are the chromaticity coordinates within the second region, which of the plurality of correction regions the measured chromaticity coordinates fall within;

a fourth step of correcting the gray-scale signal corresponding to the measured chromaticity coordinates falling within one of the correction regions by using the chromaticity correcting means corresponding to the one of the plurality of correction regions determined by the third step; and a fifth step of performing corrected image display.

2. The method of chromaticity adjustment of a display device according to claim 1, wherein the image displayed on the display device comprises a white-color display with a maximum gray level.

3. The method of chromaticity adjustment of a display device according to claim 1, wherein the correcting comprises correcting a chromaticity by changing a γ characteristic of the display device.

4. The method of chromaticity adjustment of a display device according to claim 3, wherein:

the plurality of pixels comprise a red pixel, a green pixel, and a blue pixel; and the correcting further comprises correcting the gray-scale signal to be supplied to the red pixel, the gray-scale signal to be supplied to the green pixel, and the gray-scale signal to be supplied to the blue pixel independently of one another.

5. The method of chromaticity adjustment of a display device according to claim 1, wherein:

the drive circuit stores correction data corresponding to each of the plurality of correction regions in advance; and the correcting comprises selecting the correction data corresponding to the determined one of the plurality of correction regions and correcting the gray-scale signal based on the selected correction data.

6. The method of chromaticity adjustment of a display device according to claim 1, wherein:

the drive circuit acquires correction data corresponding to each of the plurality of correction regions; and the correcting comprises correcting the gray-scale signal based on the acquired correction data.

7. The method of chromaticity adjustment of a display device according to claim 1, wherein the display device further comprises a backlight unit using a white LED as a light source and a liquid crystal display panel disposed on a side of a surface of the backlight unit from which a backlight beam is emitted.

8. A method of chromaticity adjustment of a display device including a plurality of pixels and a drive circuit for generating a gray-scale signal corresponding to a video signal input from an external portion and supplying the gray-scale signal to the plurality of pixels, the method comprising:

measuring chromaticity coordinates of an image displayed on the display device;

determining whether the measured chromaticity coordinates are chromaticity coordinates within a first region of a CIE xy chromaticity diagram the image that does not need a chromaticity correction or chromaticity coordinates within a second region of the CIE xy chromaticity diagram that needs the chromaticity correction;

determining, if the measured chromaticity coordinates are the chromaticity coordinates within the second region, which of a plurality of correction regions obtained by dividing the second region the chromaticity coordinates fall within;

correcting the gray-scale signal corresponding to the video signal by using chromaticity correcting means corresponding to the determined one of the plurality of correction regions, wherein the chromaticity correction means are different from each other for each of the correction regions so that the chromaticity correction performed in each of the correction regions will be different from the chromaticity correction performed in the other correction regions; and performing corrected image display, wherein the correcting comprises correcting a chromaticity by changing a γ characteristic of the display device.

9. The method of chromaticity adjustment of a display device according to claim 8, wherein the chromaticity coordinates are measured at a time of white display on the display device, and wherein the correcting of chromaticity by changing the γ characteristic of the display device is performed for adjusting the whiteness of the white display.

* * * * *